US009915510B1

(12) United States Patent
Huang

(10) Patent No.: US 9,915,510 B1
(45) Date of Patent: Mar. 13, 2018

(54) VARIABLE WEIGHTED ARROW TIP

(71) Applicant: Dorge O. Huang, Henry, IL (US)

(72) Inventor: Dorge O. Huang, Henry, IL (US)

( * ) Notice: Subject to any disclaimer, the term of this patent is extended or adjusted under 35 U.S.C. 154(b) by 0 days.

(21) Appl. No.: 15/494,448

(22) Filed: Apr. 22, 2017

(51) Int. Cl.
*F42B 6/08* (2006.01)

(52) U.S. Cl.
CPC ..... *F42B 6/08* (2013.01)

(58) Field of Classification Search
CPC ..... F42B 6/08
USPC ..... 473/578, 582
See application file for complete search history.

(56) References Cited

U.S. PATENT DOCUMENTS 3,417,994 A * 12/1968 Rohrbaugh, Jr. ..... F42B 6/04 473/577
4,050,696 A * 9/1977 Troncoso, Jr. ..... F42B 6/04 473/585
5,269,534 A * 12/1993 Saunders ..... F42B 6/08 403/343
5,516,117 A * 5/1996 Rangel ..... F42B 6/04 403/288
5,902,199 A * 5/1999 Adams, Jr. ..... F42B 6/04 473/578
6,027,421 A * 2/2000 Adams, Jr. ..... F42B 6/08 473/578
8,057,330 B2 * 11/2011 Blosser ..... F42B 6/04 473/582
8,337,341 B1 * 12/2012 Huang ..... F42B 6/08 473/582
8,403,777 B1 * 3/2013 Huang ..... F42B 6/04 473/582
8,480,520 B2 * 7/2013 Webber ..... F42B 6/08 473/582
9,068,804 B2 * 6/2015 McPherson ..... F42B 6/06
9,097,500 B1 * 8/2015 Addleman ..... F42B 10/00
9,441,927 B1 * 9/2016 Huang ..... F42B 6/08
9,772,169 B2 * 9/2017 Greenwood ..... F42B 6/04
2007/0123378 A1 * 5/2007 Polando ..... F42B 6/08 473/583

* cited by examiner

*Primary Examiner* — Alexander Niconovich
(74) *Attorney, Agent, or Firm* — Donald J. Ersler

(57) ABSTRACT

A variable weighted arrow tip includes a field point and a weighted insert. The field point preferably includes a field point tip, an insert bore, a threaded tap, a first shaft diameter and a second shaft diameter. The field point tip is formed on one end of the field point and the insert bore with the threaded tap are formed in an opposing end thereof. The first and second shaft diameters are formed on a middle and substantially an end opposite the field point. The first and second shaft diameters are sized to receive first and second inner diameters of a double walled arrow shaft. The weighted insert includes a bore diameter and a threaded projection. The threaded projection is threadably received by the threaded tap. At least one o-ring groove is retained on the bore diameter. A drive cavity is formed in an end opposite the threaded projection.

12 Claims, 2 Drawing Sheets

VARIABLE WEIGHTED ARROW TIP

BACKGROUND OF THE INVENTION

1. Field of the Invention

The present invention relates generally to archery and more specifically to a variable weighted arrow tip, which allows a weight of a field point to be quickly changed by substituting a weighted insert.

2. Discussion of the Prior Art

It appears that the prior art does not teach or suggest a variable weighted arrow tip. U.S. Pat. No. 8,337,341 to Huang discloses an arrow tip. U.S. Pat. No. 9,441,927 to Huang discloses field points for double walled arrow shafts.

Accordingly, there is a clearly felt need in the art for a variable weighted arrow tip which allows a weight of a field point to be quickly changed by substituting a weighted insert.

SUMMARY OF THE INVENTION

The present invention provides a variable weighted arrow tip, which allows a weight of a field point to be quickly changed by substituting a weighted insert. The variable weighted arrow tip preferably includes a field point and a weighted insert. The field point preferably includes a field point tip, an insert bore, a threaded tap, a first shaft diameter and a second shaft diameter. The field point tip is formed on one end of the field point and the insert bore is formed in an opposing end thereof. The threaded tap is formed on a bottom of the insert bore. The first shaft diameter is formed on substantially the opposing end of the field point. The second shaft diameter is formed in substantially a middle of the field point. The second shaft diameter is terminated with an angled undercut. The first and second shaft diameters are sized to receive first and second inner diameters of a double walled arrow shaft. The weighted insert includes a bore diameter and a threaded projection. The threaded projection extends from the bore diameter. The bore diameter is slightly smaller than the insert bore. The threaded projection is sized to be threadably received by the threaded tap. At least one o-ring groove is formed around the bore diameter to receive at least one o-ring. A drive cavity is formed in an end opposite the threaded projection. The drive cavity may have any suitable shape, such as a hex, a Torq drive, a blade screw driver slot or a Philips head cavity. In use, the weighted insert is threaded into the threaded tap with an appropriate drive tool. The at least one o-ring prevents vibration and loosening of the weighted insert inside the field point during firing and impact.

Accordingly, it is an object of the present invention to provide a field point to be quickly changed by substituting a weighted insert.

These and additional objects, advantages, features and benefits of the present invention will become apparent from the following specification.

DETAILED DESCRIPTION OF THE PREFERRED EMBODIMENTS

Figure 1:
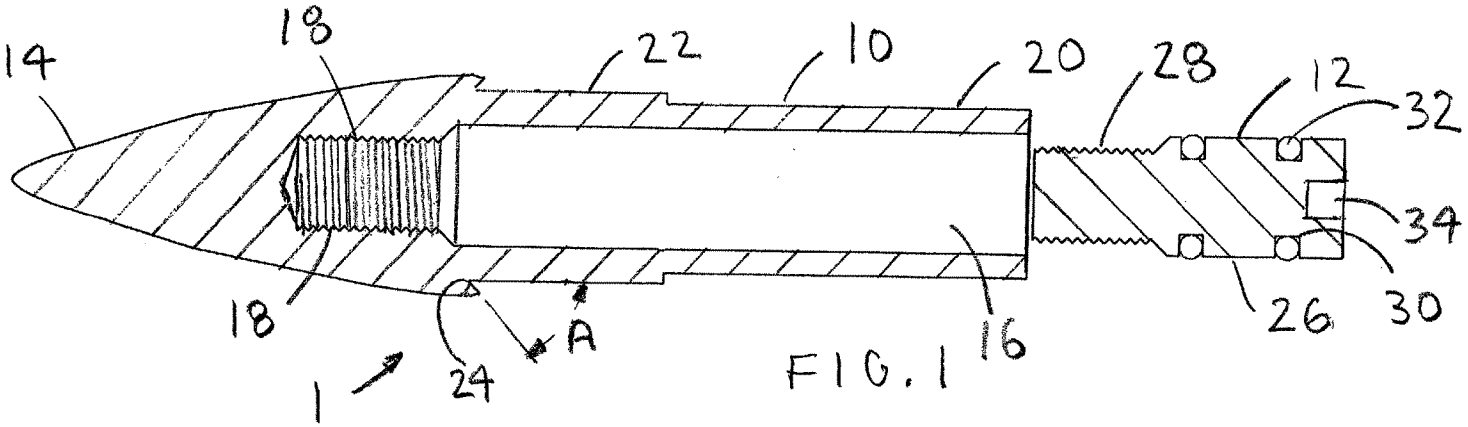
FIG. 1 is an exploded side cross-sectional view of a variable weighted arrow tip in accordance with the present invention.
Figure 2:
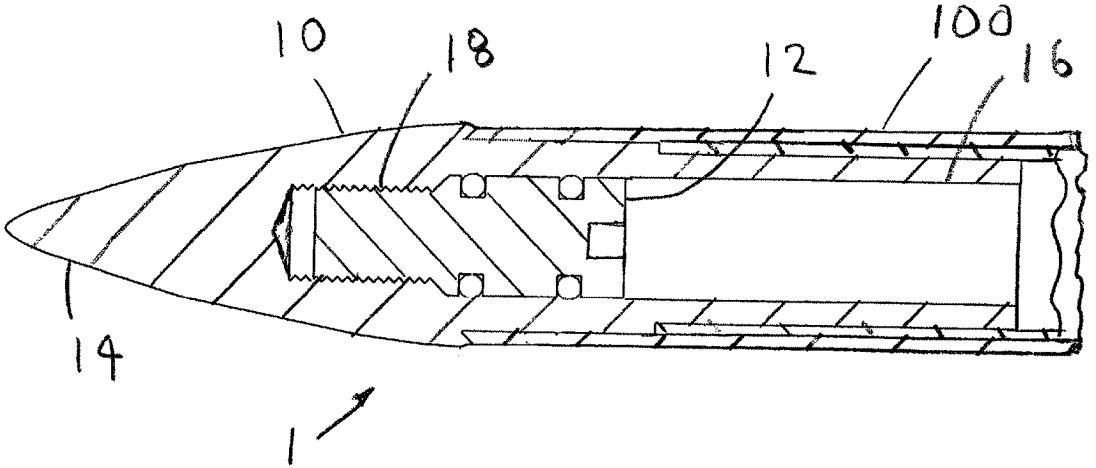
FIG. 2 is a side cross-sectional view of a variable weighted arrow tip in accordance with the present invention.
Figure 3:
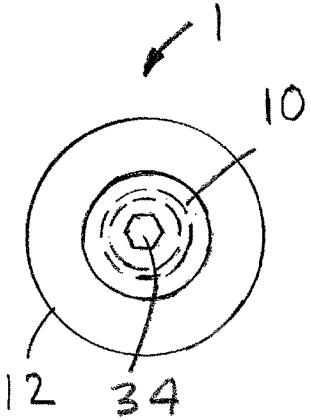
FIG. 3 is an end view of a variable weighted arrow tip in accordance with the present invention.

With reference now to the drawings, and particularly to FIG. 1, there is shown an exploded side cross-sectional view of a variable weighted arrow tip 1. With reference to FIGS. 2-3, the variable weighted arrow tip 1 preferably includes a field point 10 and a weighted insert 12. The field point 10 preferably includes a field point tip 14, an insert bore 16, a threaded tap 18, a first shaft diameter 20 and a second shaft diameter 22. The field point tip 14 is formed on one end of the field point 10 and the insert bore 16 is formed in an opposing end thereof. The threaded tap 18 is formed on a bottom of the insert bore 16. The first shaft diameter 20 is formed on substantially the opposing end of the field point 10. The second shaft diameter 22 is formed in substantially a middle of the field point 10. The second shaft diameter 22 is preferably terminated with an angled undercut 24. The angled undercut 24 forms an acute angle "A" with an axis of the second shaft diameter 22. The first and second shaft diameters 20, 22 are sized to receive first and second inner diameters of a double walled arrow shaft 100.

The weighted insert 12 preferably includes a bore diameter 26 and a threaded projection 28. The threaded projection 28 extends from the bore diameter 26. However, the weighted insert 12 may be retained in the insert bore 16 with a tacky substance instead of the threaded projection 28. The bore diameter 26 is slightly smaller than the insert bore 16. The threaded projection 28 is sized to be threadably received by the threaded tap 18. At least one o-ring groove 30 is formed around the bore diameter 26 to receive at least one o-ring 32. A drive cavity 34 is formed in the weighted insert on an end opposite the threaded projection 28. The drive cavity 34 may have any suitable shape, such as a hex, a Torq drive, a blade screw driver slot or a Philips head cavity. In use, the weighted insert 12 is threaded into the threaded tap 18 with a drive tool (not shown). The at least one o-ring 32 prevents vibration and loosening of the weighted insert 12 inside the field point 10 during firing and impact.

Figure 4:
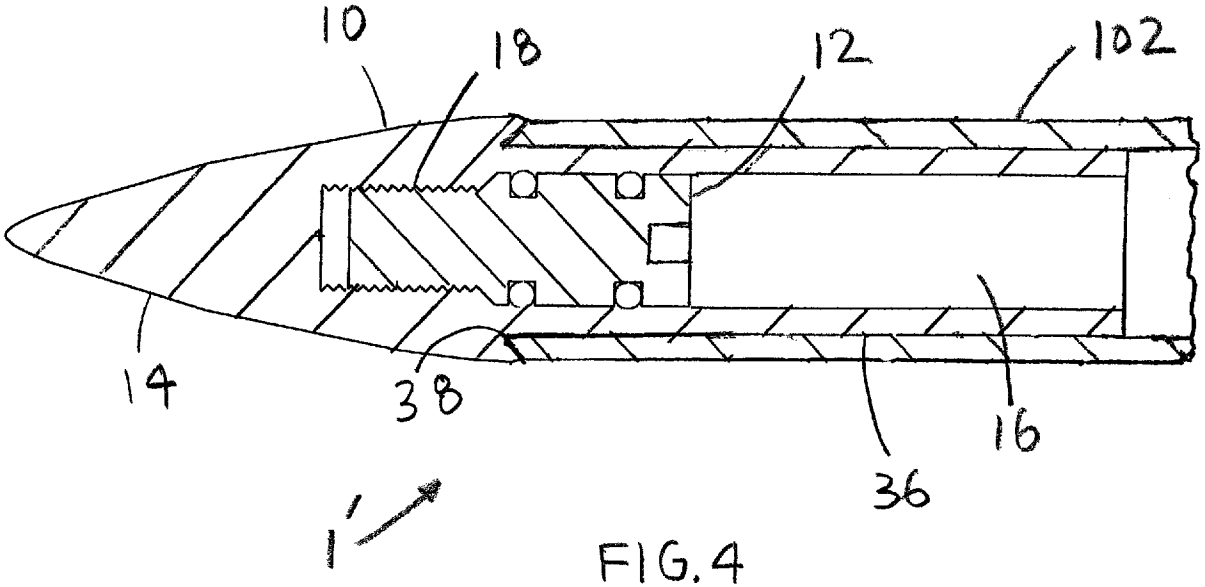
FIG. 4 is a side cross-sectional view of a variable weighted arrow tip for a single wall arrow shaft in accordance with the present invention.

With reference to FIG. 4, a side cross-sectional view of a variable weighted arrow tip 1' for a single wall arrow shaft is shown. The variable weighted arrow tip 1' includes all the features of the variable weighted arrow tip 1, but with only a single shaft diameter 36 and preferably an angled undercut 38. The single shaft diameter 36 is formed on a middle of the field point 10 and substantially on an end opposite the field point tip 14. The single shaft diameter 36 is sized to receive a single wall arrow shaft 102.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A variable weighted arrow tip comprising:

a field point includes a field point tip, an insert bore and a threaded tap, said field point tip is formed on one end of said field point, said insert bore is formed in an opposing end of said field point, said threaded tap is formed on a bottom of said insert bore, wherein an outer diameter of said field point is sized for insertion into an arrow shaft; and a weighted insert includes a bore diameter and a threaded projection, said bore diameter is sized to receive said insert bore, said bore diameter is greater in diameter than said threaded projection, said threaded tap is sized to threadably receive said threaded projection, at least one o-ring groove is formed in said bore diameter to receive at least one o-ring.

2. The variable weighted arrow tip of claim 1 wherein:

a first shaft diameter is formed on substantially an opposing end of said field point, a second shaft diameter is formed in substantially a middle of said field point, wherein said first and second shaft diameters are sized to receive the arrow shaft having a double wall.

3. The variable weighted arrow tip of claim 2 wherein:

said second shaft diameter is terminated with an angled undercut.

4. The variable weighted arrow tip of claim 1 wherein:

a single shaft diameter is formed on a middle of the field point and substantially on an end opposite said field point tip, wherein said single shaft diameter is sized to receive the arrow shaft having a single wall.

5. The variable weighted arrow tip of claim 4 wherein:

said single shaft diameter is terminated with an angled undercut.

6. The variable weighted arrow tip of claim 1 wherein:

a drive socket is formed in an end opposite said threaded projection.

7. A variable weighted arrow tip comprising:

a field point includes a field point tip, an insert bore and a threaded tap, said field point tip is formed on one end of said field point, said insert bore is formed in an opposing end of said field point, said threaded tap is formed on a bottom of said insert bore, wherein an outer diameter of said field point is sized for insertion into an arrow shaft; and a weighted insert includes a bore diameter and a threaded projection, said bore diameter is sized to receive said insert bore, said bore diameter is smooth and has a greater diameter measurement than said threaded tap, said threaded tap is sized to threadably receive said threaded projection, two o-ring grooves are formed in said bore diameter to receive two o-rings.

8. The variable weighted arrow tip of claim 7 wherein:

a first shaft diameter is formed on substantially an opposing end of said field point, a second shaft diameter is formed in substantially a middle of said field point, wherein said first and second shaft diameters are sized to receive the arrow shaft having a double wall.

9. The variable weighted arrow tip of claim 8 wherein:

said second shaft diameter is terminated with an angled undercut.

10. The variable weighted arrow tip of claim 7 wherein:

a single shaft diameter is formed on a middle of the field point and substantially on an end opposite said field point tip, wherein said single shaft diameter is sized to receive the arrow shaft having a single wall.

11. The variable weighted arrow tip of claim 10 wherein:

said single shaft diameter is terminated with an angled undercut.

12. The variable weighted arrow tip of claim 7 wherein:

a drive socket is formed in an end opposite said threaded projection.

* * * * *